United States Patent [19]

Glaesener

[11] 4,358,090

[45] Nov. 9, 1982

[54] SOUND BARRIER FOR HIGHWAY AND OTHER TRAFFIC

[75] Inventor: Ernest Glaesener, Luxembourg, Luxembourg

[73] Assignee: Arbed S.A., Luxembourg, Luxembourg

[21] Appl. No.: 114,330

[22] Filed: Jan. 22, 1980

[30] Foreign Application Priority Data

Jan. 23, 1979 [LU] Luxembourg ..... 80815

[51] Int. Cl.[3] ..... E01F 15/00; B64F 1/26

[52] U.S. Cl. ..... 256/13.1; 256/1; 52/144; 181/210; 404/6

[58] Field of Search ..... 256/13.1; 181/210; 404/6, 7, 8; 52/144

[56] References Cited

U.S. PATENT DOCUMENTS

| | | | |
|---|---|---|---|
| 3,114,303 | 12/1963 | Oberbach | 256/13.1 X |
| 3,630,310 | 12/1971 | Federer | 181/210 |
| 3,704,861 | 12/1972 | Glaesener | 256/13.1 |
| 3,783,968 | 1/1974 | Derry | 256/13.1 X |
| 3,963,218 | 6/1976 | Glaesener | 256/13.1 |
| 3,966,173 | 6/1976 | Glaesener | 256/13.1 |
| 3,983,956 | 10/1976 | Manhart | 256/13.1 X |
| 4,042,061 | 8/1977 | Murakami | 181/210 |
| 4,214,411 | 7/1980 | Pickett | 52/144 |

FOREIGN PATENT DOCUMENTS

| | | | |
|---|---|---|---|
| 840107 | 4/1970 | Canada | 256/13.1 |
| 2804855 | 8/1979 | Fed. Rep. of Germany | 404/8 |
| 2384896 | 10/1978 | France | 404/7 |
| 1209646 | 10/1970 | United Kingdom | 404/7 |

*Primary Examiner*—James Kee Chi

*Attorney, Agent, or Firm*—Karl F. Ross

[57] ABSTRACT

A combined road and sound barrier has its upper and lower portions formed as hollow profiles filled with synthetic resin foam.

16 Claims, 12 Drawing Figures

818
816
817
909
900

409
413a
401d
401a
413b
408
401b 608
601
611
613
408
413c
411
401c
404
413d

SOUND BARRIER FOR HIGHWAY AND OTHER TRAFFIC

CROSS REFERENCE TO RELATED APPLICATION

This application is related to my concurrently filed copending application Ser. No. 114,287 entitled *ROAD BARRIER.*

FIELD OF THE INVENTION

My present invention relates to a sound barrier for the noises generated by vehicles and, more particularly, to a sound barrier adapted to be disposed along a roadway and which can serve exclusively as a sound barrier or as a combined sound barrier and safety barrier.

BACKGROUND OF THE INVENTION

As highways increasingly are compelled to traverse residential areas, hospital zones and even industrial areas in which silence is a virtue, a problem arises with respect to the noise generated by the vehicles traveling on such highways. The problem is particularly pronounced as vehicle size increases and vehicle speed increases both for heavy vehicles and light vehicles.

Not only does the sound generated by traveling vehicles rank as an inconvenience to neighbors of such highways, but there is increasing evidence that continuous high noise levels associated with vehicle travel are detrimental to the health of individuals who dwell or work in the vicinity of highways, throughways, heavily traveled streets and avenues, and even carparks where both engine starting and wheel noise may be significant.

Consequently, proposals have been made to limit the transmission of sound (usually noise) from a vehicle area, e.g. a highway, to adjoining areas involving sound barriers which can be placed along the edges of the street or highway.

It is a common practice to flank the traveling lanes or shoulders of highways and streets with wheel-engaging barriers of small height, generally less than the diameter of an ordinary automobile wheel, to serve as a safety guide or the like. Such safety barriers may be in the form of curbs or simple ridges which flank the road or street.

Somewhat higher road barriers have also been proposed as described, for example, in my U.S. Pat. Nos. 3,603,562; 3,704,861 3,784,167; 3,963,218; 3,881,697; 3,966,173 and 4,047,701; and in the documents or references cited or made of record therein.

In these road barriers, guide strips or planks of considerable length and hence significant transverse flexibility, are spaced above the ground and span spaced apart posts and are intended to guide the vehicle back into a travel lane without excessive rebounding or damage to the vehicle.

In the erection of such structures, the fabrication of new highways, the rebuilding of old highways and application of safety devices including vehicle-guide barriers to existing highways, it is desirable to consider all aspects of the problem, namely, the desire to provide effective road barriers and to provide acoustic barriers where required. Naturally, the current technique of providing sound barriers in addition to existing safety barriers is expensive but perhaps more important is the fact that in many cases there is insufficient room for both safety barriers and acoustic barriers so that a sound-blocking solution frequently results in an unsatisfactory safety level and vice versa. An alternative, of course, is to increase the width of the highway, frequently at prohibitive cost, and the right of way associated therewith.

OBJECTS OF THE INVENTION

It is, therefore, the principal object of the present invention to provide an effective solution to the problem outlined above.

Another object of this invention is to provide a combined safety and sound barrier which occupies a minimum of space, is highly efficient for both safety and acoustic blocking purposes and which is of comparatively low cost.

Another object of the invention is to provide a second barrier for highways or the like which can be erected rapidly and at low cost and is free from the disadvantages of earlier systems.

SUMMARY OF THE INVENTION

These objects and others which will become apparent hereinafter are attained, in accordance with the present invention, in a combination safety and acoustic barrier which comprises a lower portion proximal to and advantageously extending along the ground, supported therein at spaced apart locations along the highway or street, and symmetrical with respect to a vertical longitudinal median plane through this lower portion which is formed as a hollow-profile element of thin-wall steel sheet containing a foamed synthetic resin and advantageously having outwardly extending portions spreading gradually outwardly from a portion of more limited thickness, the lower portion of this barrier being surmounted by an upper or wall portion which is substantially flat and planar at least for a portion of its height and serving as a sound barrier. This upper portion or wall is likewise formed as a foamed synthetic resin-filled hollow profile of thin sheet metal.

According to the invention, the lower portion, which can have a height somewhat greater than the height of normal automotive vehicle wheels, say about 1 meter, can be surmounted by a flat upper portion having an additional height of at least 1 meter and preferably between 1 meter and 3 meters. In a preferred, mode, the height of the upper portion of the barrier is between 1.5 and two times the height of the lower portion.

The hollow profile element of the lower portion is defined at least on three sides as a steel-sheet member, can rest upon the ground, and can be provided with posts or feet anchored therein. The sheet metal is of the thickness described in my above-mentioned patents as is the density and composition of the synthetic resin foam.

The present invention thus provides a combination road and sound barrier containing a foamed synthetic resin material and which, by reason of the combination of sheet steel hollow profile and the foamed synthetic resin filling, is both stable and elastic.

According to the present invention, therefore, a sound barrier wall is mounted on top of a guide rail and is connected thereto. The advantage of vehicle protection against running off of the side of the road or crossing into oncoming traffic is thereby combined with the advantage of noise interception with the single assembly being anchored to the ground by posts or the like. Previously existing guide rail assemblies in accordance with the present invention can thus be formed with sound barriers or both sound and road barriers can be formed unitarily and prefabricated for disposition contiguously along the road.

The connection of the hollow profile elements in both the vertical and horizontal directions can be effected by forming a tongue-and-groove type connection whereby one of the elements is set back by at least the thickness of the sheet metal to form a tongue which is inserted in a groove formed by the other element. The socket-forming member need not be stepped and the connection can be made by rivets, bolts, adhesives or the like.

The road-barrier portion of the unit can be provided unitarily with downwardly extending feet or posts which can be received in sockets or holes in the ground and which do not pose a danger to the vehicle or the driver. Preferably these posts can be hollow profiles which are filled with the foamed synthetic resin material as well.

The walls of the assembly of the present invention should be free from edges and discontinuities and preferably completely smooth so that, by comparison with concrete wheel guides, there is significant friction against the wheels which might cause the wheel to ride up or catch.

In a preferred embodiment of the invention, the road-barrier portion has an upright mushroom-shaped cross section with its head spaced above the ground and overhanging a diverging portion.

When a vehicle with its wheel or fender engages beneath the head, a downward force is applied to prevent the vehicle from jumping off the road or into an oncoming-traffic lane.

The mushroom head is positioned at a height usually greater than the road barrier planks of the prior art system, say above 1 meter, so that an effective guide is provided for the wheels or tires along the concave portion of the road barriers to permit the kinetic energy of the vehicle to be dissipated without significant damage to the vehicle or the barrier. This, however, is especially significant along curves.

According to another embodiment of the invention, the hollow profile element has a trapezoidal configuration with its broad base turned downwardly and resting upon the ground. The sides include an angle to the vertical of at most 30°. The advantage of this embodiment is primarily its simplicity since it can be readily and inexpensively fabricated from flat steel sheet which minimizes the tendency of the wheel to ride up or any detrimental engagement with the fender.

In both embodiments the lateral walls of the lower hollow profile element, i.e. the road barrier, can be corrugated so that the corrugations run parallel to the vehicle travel direction.

The road barrier can be provided with interior stiffening members which can be throughgoing or localized and, when posts are used to support the barrier, they can be designed to fit into the lower or both barrier portions and into the ground.

The post can be one piece, two piece or three piece. In the two-piece construction, one portion extends into the ground opening or a socket while the other extends into the lower hollow profile.

In the three-piece construction, one piece extends into the lower hollow profile, another piece into the ground opening and a third fits into the other two and has a central bulge. At ground level an intentional break point is provided to allow the post to shear away.

The upper hollow profile member can be a plate of sandwich type construction and can have a downwardly open portion receiving a projection from the lower barrier member or vice versa. In either case, the bottom of the upper portion should conform to the top of the lower or road-barrier portion. The upper portion can be formed by a single hollow profile element extending over the entire height of the sound barrier or form a plurality of horizontal rows of superimposed and interengaged elements. In either case interior stiffening can be provided, preferably extending in the vertical direction and even into the lower hollow profile. The sound barrier can be advantageously curved to overhang the traffic lane from which sound emission is to be blocked.

Finally, the upper hollow profile element can be provided with perforations which extend through the sheet metal walls to terminate at the synthetic resin foam.

BRIEF DESCRIPTION OF THE DRAWING

The above and other objectives, features and advantages of the present invention will become more readily apparent from the following description, reference being made to the accompanying drawing in which.

SPECIFIC DESCRIPTION

Figure 1:
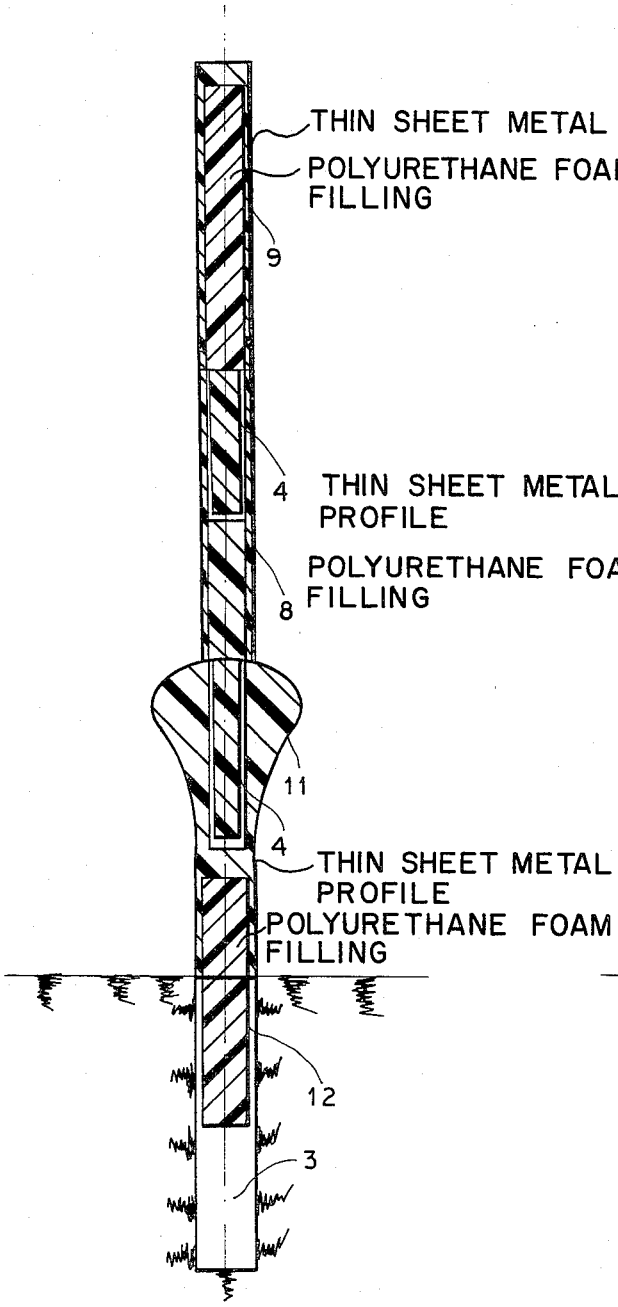
FIG. 1 is a diagrammatic vertical section showing a combined road and sound barrier according to the invention in which the lower portion is generally at mushroom-shaped cross section.
Figure 2:
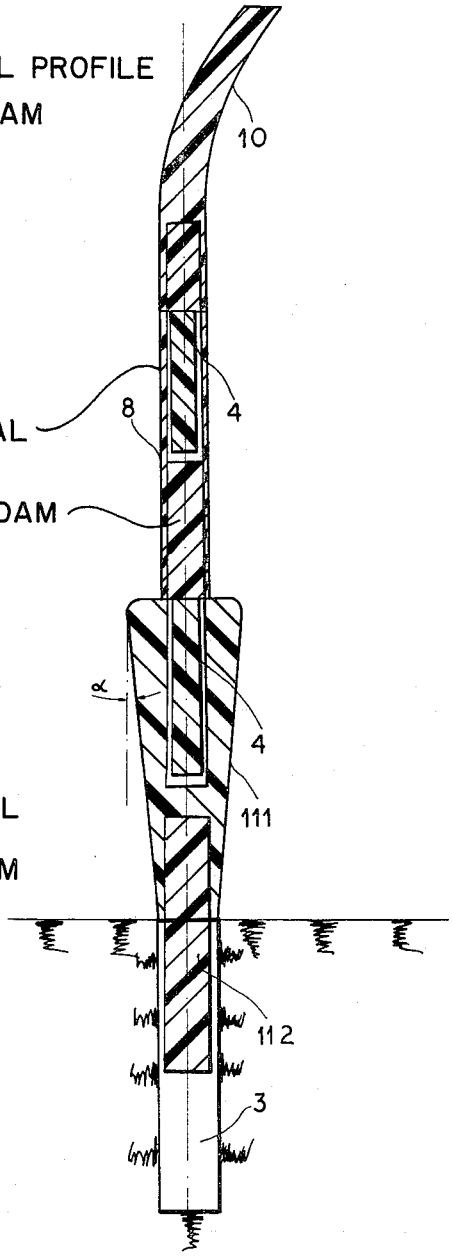
FIG. 2 is a view similar to FIG. 1 in which the upper portion is curved and the lower portion is of trapezoidal profile.

As can be seen from FIGS. 1 and 2, each of the embodiments illustrated therein comprises a first sound-barrier portion 8 surmounted by an upper sound-barrier portion 9 or 10, the first being straight while the second is curved inwardly toward the vehicle traffic line from which sound is to be blocked.

The parts 8 are connected with the respective lower portions 11, 111 by stiffeners 4 and identical stiffeners can connect the parts 8 with the respective parts 9 and 10.

The road-barrier portions 11 and 111 can be provided with posts 12, 112 which anchor them in sockets 3 formed in the ground.

Figure 3:
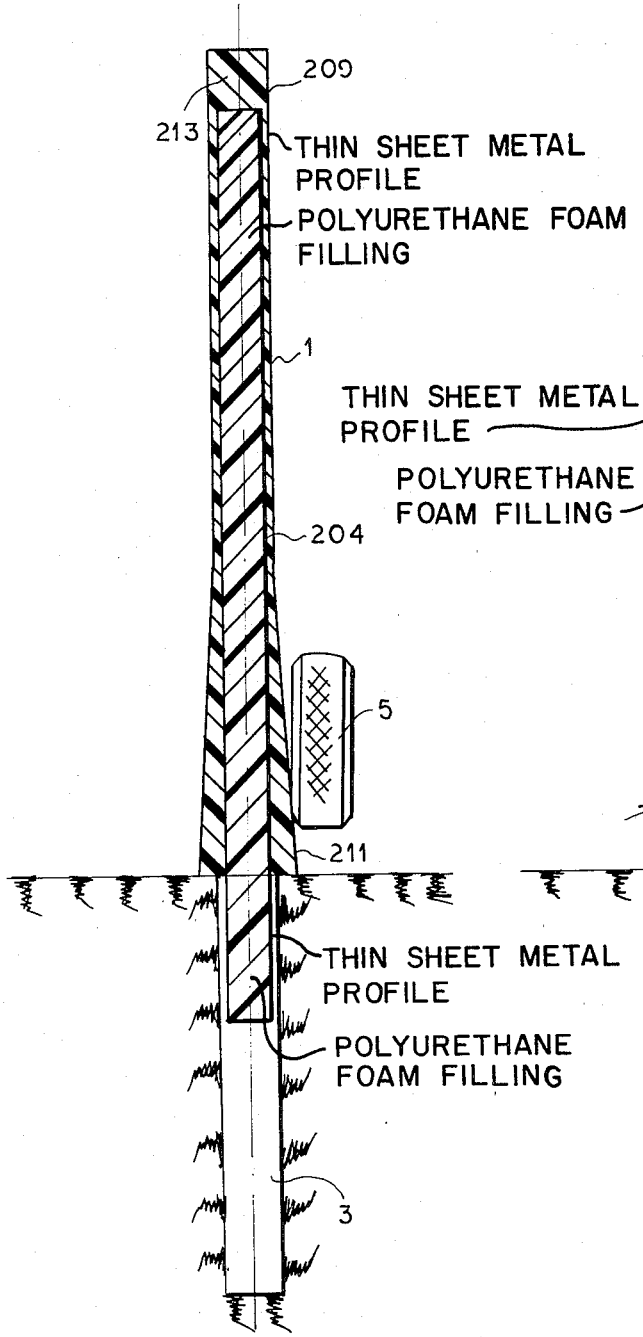
FIGS. 3 and 4 are similar diagrammatic cross sections utilizing generally trapezoidal lower portions and straight and curved upper portions, respectively, the upper and lower portions being unitary with each other.
Figure 4:
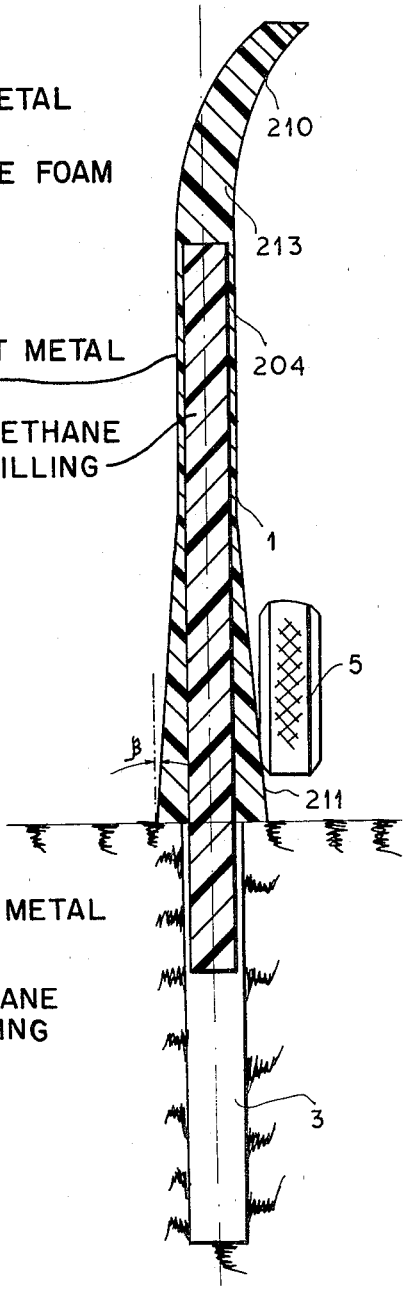

FIGS. 3 and 4 show an embodiment in which the lower portion 211 is connected to the respective upper portion 209 or 210, respectively straight and curved, to form a unitary profile body 1 anchored in the ground opening 3 by stiffeners 204 extending through both portions. The profile bodies contain foamed synthetic resin fillings 213, e.g. of polyurethane foam.

Figure 5:
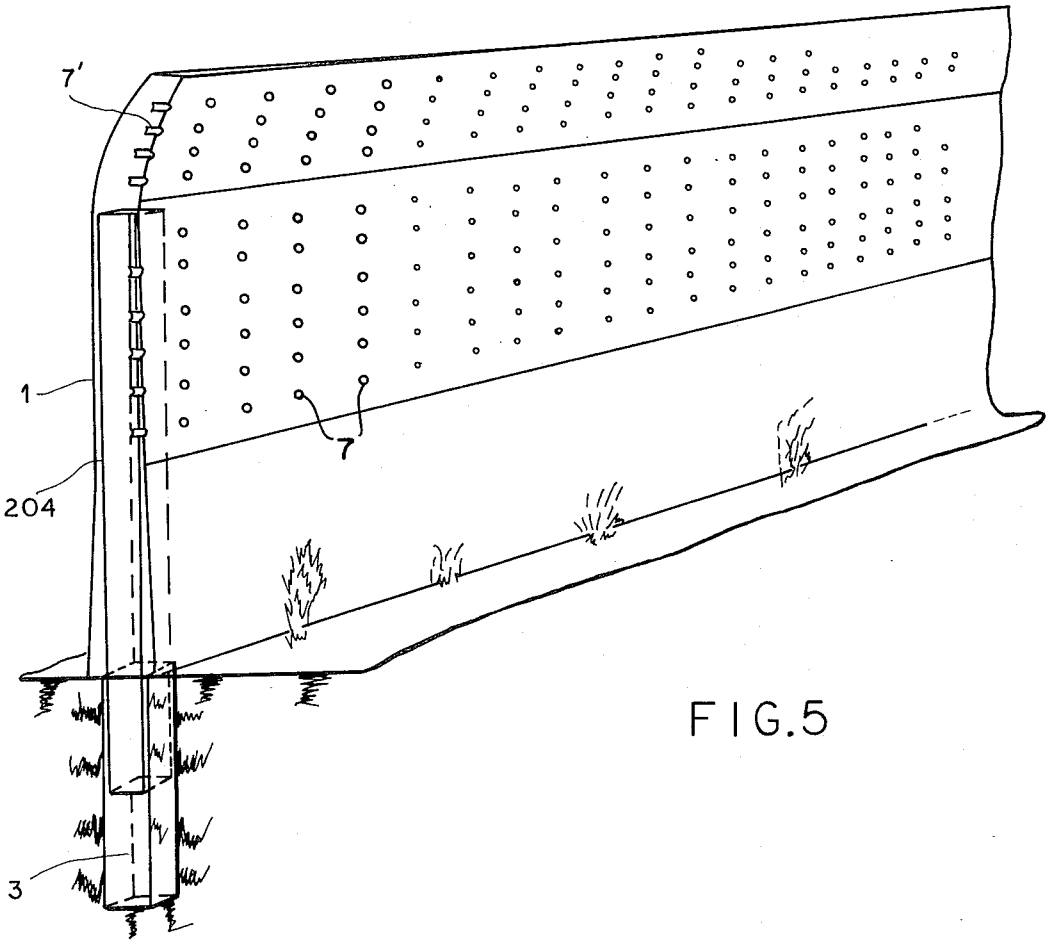
FIG. 5 is a perspective view of the embodiment of FIG. 4.

FIG. 5 shows that openings 7 can be formed in the thin sheet metal profiles, which can have thicknesses of the order of a fraction of a millimeter to several millimeters. The hole 7 extends into the synthetic resin material as can be seen at 7' in FIG. 5.

Figure 6:
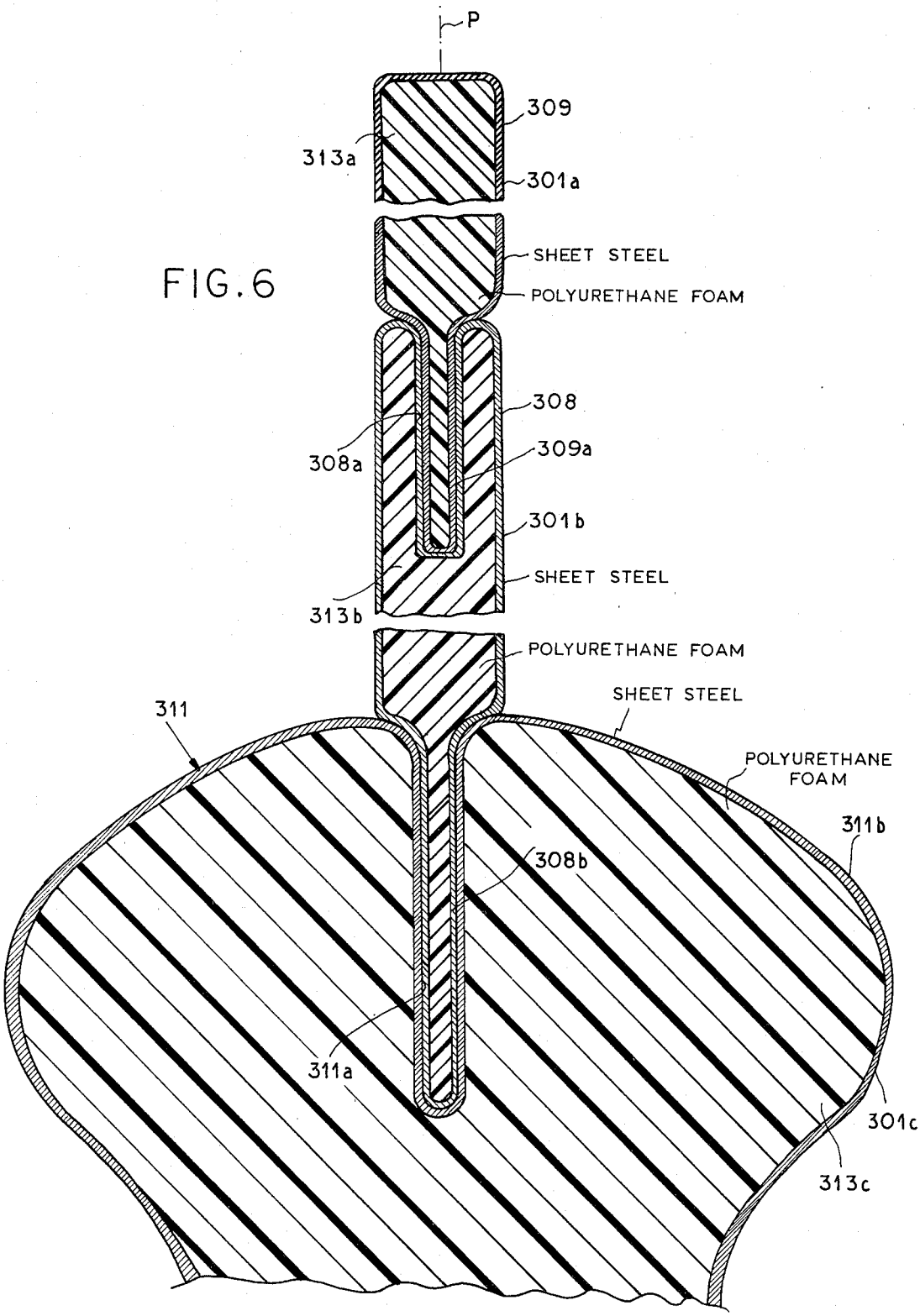
FIG. 6 is a fragmentary cross section showing principles of the embodiment of FIG. 1 in greater detail.

Referring now to FIG. 6, it can be seen that an upper member 309 can be formed with the sheet metal shell 301*a* and filled with the foamed synthetic resin 313*a* while being provided with a downwardly extended tongue 309*a* received in a socket 308*a* of the lower member 308 which likewise has a metal shell 301*b* and a foamed polyurethane filling 313*b*. The tongue 308*b* of the lower sound-barrier member can be received in a socket 311*a* formed in the mushroom-section head 311*b* of the road-barrier member 311 which can correspond in configuration to the body 11 mentioned previously. The road-barrier member 311 is formed with the hollow sheet metal profile 301*c* filled with the polyurethane form 313*c*. This lower profile is symmetrical about its longitudinal median plane P and is enclosed at least on three sides, as shown, by a sheet metal wall resting upon the ground to form a longitudinally continous head member along the road. The wall formed by members 308 and 307 provides the sound barrier.

Figures 7, 9, 11, 12:
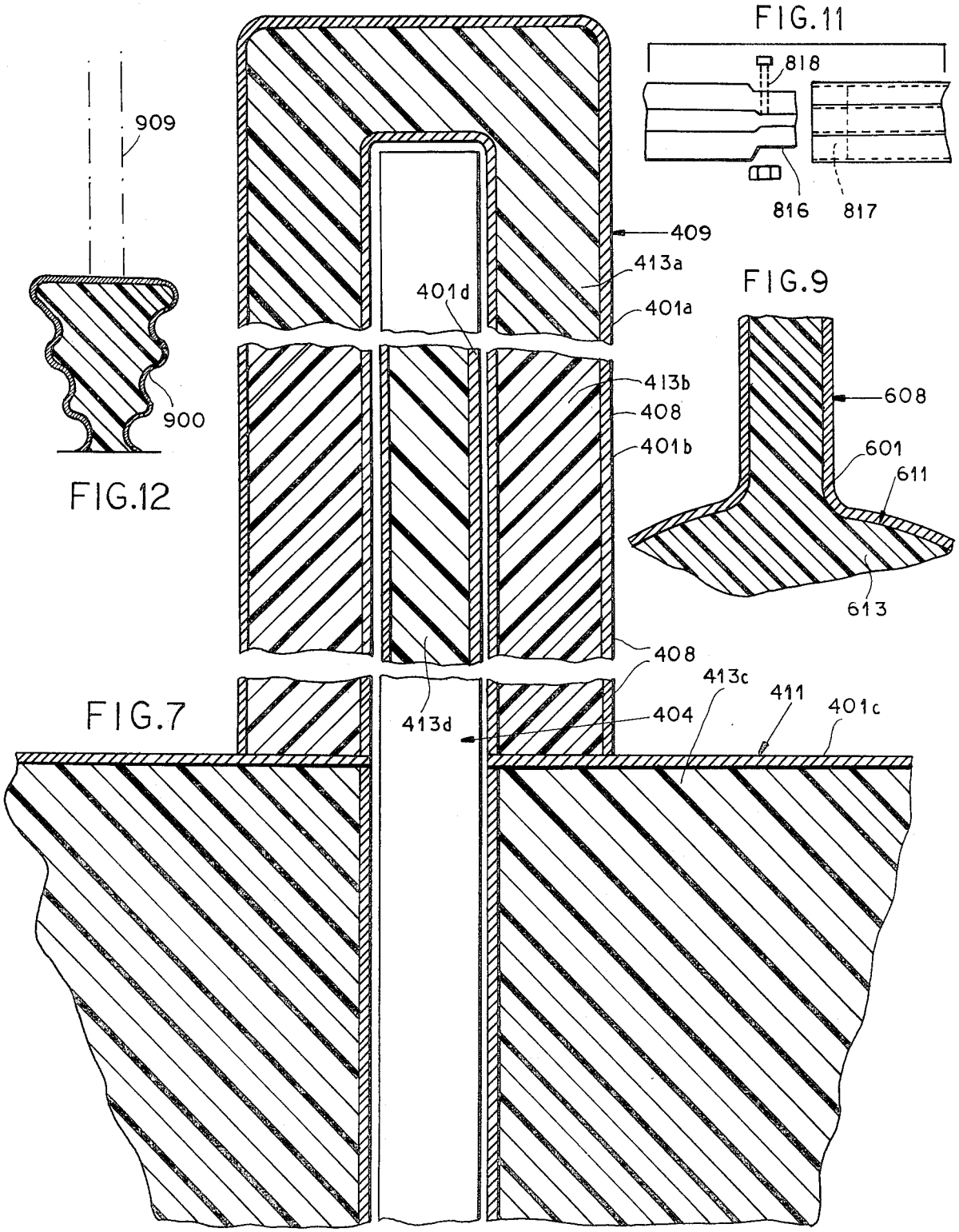
FIG. 7 is a view similar to FIG. 6 but illustrating another embodiment of the invention.
FIG. 9 is a detail view illustrating another aspect of the invention.
FIG. 11 is a diagrammatic plan view illustrating the longitudinal connection of elements according to the invention into a continous barrier.
FIG. 12 is a diagrammatic section showing another feature of the invention.

A continous stiffening member 404 is used in FIG. 7 to connect the upper member 409 and the lower member 408 of the sound barrier to one another and to the road-barrier portion 411. The stiffener 404, which can also provide the post receivable in the openings 3, also can be formed as a hollow profile with a wall 401*d* of the sheet steel enclosing a body of foamed synthetic resin represented at 413*d*. Members 411, 408 and 409 are provided with respective sheet metal profiles 401*a*, 401*b* and 401*c* filled with the foamed synthetic resin 413*a*, 413*b* and 413*c*.

Figures 8, 10:
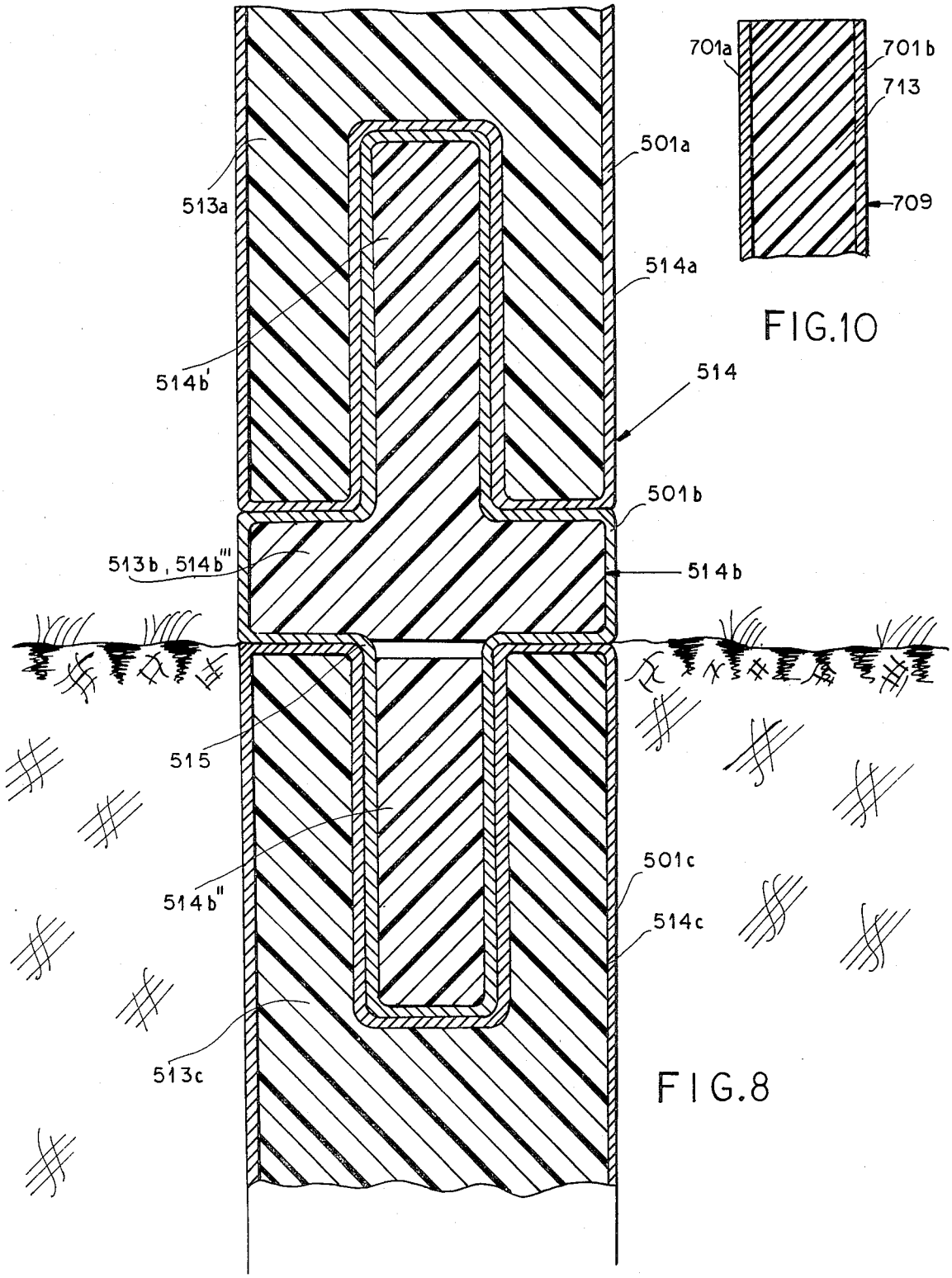
FIG. 8 is a cross section of a portion of a post used in conjunction with a compound barrier according to the invention.
FIG. 10 is a cross section through a sandwich-type wall construction which can be used in accordance with the principles of the invention.

In FIG. 8, I have shown a particularly preferred construction of a post 514 which mounts the barrier assembly to the ground. This post is a tripartite body having an upper portion 514*a*, an intermediate portion 514*b* and a low portion 514*c*. The upper and lower portions are identical and receive tongues 514*b'* and 514*b''* of the intermediate portion 514*b* which has an outwardly extending bulge or flange 514*b'''* between the upper and lower portions.

Each of these post parts can comprise a sheet metal profile 501*a*, 501*b*, 501*c* filled with the foamed synthetic resin material 513*a*, 513*b*, 513*c*. A weak or intentional break zone is formed at 515, e.g. by interrupting the foam filling in the intermediate member in this region so that, upon impact, the post can shear away at this location.

FIG. 9 indicates that the mushroom-shaped lower member 611 and the sound barrier wall 608 can be formed entirely with one another having a common sheet metal profile 601 and being filled with the polyurethane foam 613. Alternatively, the sound-barrier wall can be a plank 709 of sandwich construction having inner and outer layers 701*a* and 701*b* bridged by a core 713 of the synthetic resin material.

The barrier parts, as shown in FIG. 1, can be longitudinally connected together by stepping one end 816 of one another so that it fits into a curve 817 formed in the next member, bolts 818 being passed through the assembly to hold the two barriers together.

In FIG. 1 the road barrier has the erect mushroom-shape profile described previously while in FIG. 2 the road barrier has the configuration of an inverted trapezoid with the flanks including an angle $\alpha$ with that vertical, this angle being less than 30°. In FIGS. 3 and 4 the angle $\delta$ included between the flanks of the trapezoid, whose broad base is turned downwardly, is likewise less than 30°. These flanks can be longitudinally corrugated as shown in FIG. 12 at 900, the sound-barrier extension being represented at 901 in dot-dash lines.

The effect of the engagement of wheel 5 of the vehicle with the road barrier portion can be seen in FIGS. 3 and 4.

I claim:

1. A barrier assembly adapted to be disposed along a traffic lane comprising:

a lower road-barrier portion disposed along the ground along said lane and engageable with a vehicle to limit the tendency of said vehicle to leave said lane, said road-barrier portion being formed along at least three sides as a sheet-metal profile and being filled with a foamed synthetic resin, said road-barrier portion extending to the ground and having a bottom edge lying longitudinally therealong and an upper edge, said road-barrier portion being of greater width at an upper one of said edges than at the bottom edge and progressively widening smoothly from said bottom edge toward said upper edge, said road-barrier portion being symmetrical to a vertical longitudinal median plane therethrough;

post means for anchoring said barrier portion to the ground, said post means consisting of posts completely concealed in said road-barrier portion and in the ground; and a sound-barrier portion at least as high as said road-barrier portion and surmounting said road-barrier portion while being connected thereto, said sound-barrier portion consisting of a hollow sheet-metal profile filled with a foamed synthetic resin material, said sound-barrier portion being narrower than said road barrier portion at least in the region of said upper edge.

2. The assembly defined in claim 1 wherein said assembly is formed at one longitudinal end thereof with a stepped portion receivable in the opposite end of a corresponding assembly for inter-connecting of a multiplicity of single assemblies into a continous barrier along said lane.

3. The assembly defined in claim 1 wherein said road-barrier portion has a cross section of an upright mushroom shape.

4. The assembly defined in claim 1 wherein said road-barrier portion has the configuration of a trapezoid having a base resting on the ground and a pair of flanks including angles to the vertical of at most 30°.

5. The assembly defined in claim 1 wherein said road-barrier portion is formed with flanks extending along said lane which are corrugated with corrugations running parallel to the direction of vehicle travel along said lane.

6. The assembly defined in claim 1, further comprising a stiffener embedded in said synthetic resin material of said road-barrier portion.

7. The assembly defined in claim 1 wherein said post means includes a post having at least two parts, one of said parts extending into said road-barrier portion and another of said parts being engaged in the ground.

8. The assembly defined in claim 7 wherein said post consists of three parts including a first part anchored to the ground, a second part secured to said road-barrier portion and a third part fitting into said first and second part and provided with a central bulge.

9. The assembly defined in claim 1 wherein said post means includes a post having means forming an intentional break zone.

10. The assembly defined in claim 1 wherein said sound-barrier portion is of a flat plate shape.

11. The assembly defined in claim 1 wherein said portions are unitarily connected with one another.

12. The assembly defined in claim 1 wherein said road-barrier portion has an upwardly open recess and said sound-barrier portion has a projection extending into said recess.

13. The assembly defined in claim 1 wherein said sound-barrier portion is provided with internal stiffeners.

14. The assembly defined in claim 12 wherein said stiffeners lie in vertical planes and extend into said road-barrier portions.

15. The assembly defined in claim 1 wherein the upper portion of said sound-barrier portion is curved upwardly inwardly toward said lane.

16. The assembly defined in claim 1 wherein the profile of said sound-barrier portion is perforated.

* * * * *